US007454328B2

(12) United States Patent
Yamaura et al.

(10) Patent No.: US 7,454,328 B2
(45) Date of Patent: Nov. 18, 2008

(54) SPEECH ENCODING SYSTEM, AND SPEECH ENCODING METHOD

(75) Inventors: Tadashi Yamaura, Tokyo (JP); Hirohisa Tasaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 918 days.

(21) Appl. No.: 10/433,354

(22) PCT Filed: Apr. 26, 2001

(86) PCT No.: PCT/JP01/03659

§ 371 (c)(1),
(2), (4) Date: Jun. 2, 2003

(87) PCT Pub. No.: WO02/054386

PCT Pub. Date: Jul. 11, 2002

(65) Prior Publication Data

US 2004/0049382 A1 Mar. 11, 2004

(30) Foreign Application Priority Data

Dec. 26, 2000 (JP) ..... 2000-396061

(51) Int. Cl.
*G10L 19/00* (2006.01)
*G10L 19/04* (2006.01)
*G10L 19/12* (2006.01)
*G10L 21/02* (2006.01)

(52) U.S. Cl. ..... 704/220; 704/223; 704/225; 704/226; 704/219; 704/233

(58) Field of Classification Search ..... 704/220, 704/223, 225, 219, 233, 226
See application file for complete search history.

(56) References Cited

U.S. PATENT DOCUMENTS 5,692,101 A 11/1997 Gerson et al.
5,828,996 A * 10/1998 Iijima et al. ..... 704/220
5,848,387 A * 12/1998 Nishiguchi et al. ..... 704/214

(Continued)

FOREIGN PATENT DOCUMENTS

JP 5-6200 A 1/1993

(Continued)

OTHER PUBLICATIONS

Ubael A et al : "A multi-band CELP wideband speech coder", 1997, IEEE International Conference on Acoustics, Speech, and Signal Processing, vol. 2; Apr. 21-24, 1997, pp. 1367-1370.*

(Continued)

*Primary Examiner*—David R Hudspeth
*Assistant Examiner*—Abdelali Serrou
(74) *Attorney, Agent, or Firm*—Birch, Stewart, Kolasch & Birch, LLP

(57) ABSTRACT

A speech encoding apparatus calculates encoding distortion of a noise-like fixed code vector and multiplies the encoding distortion by a fixed weight corresponding to the noise-like degree of the noise-like fixed code vector, calculates encoding distortion of a non-noise-like fixed code vector and multiplies the encoding distortion by a fixed weight corresponding to the non-noise-like fixed code vector, and selects the fixed excitation code associated with multiplication result with a smaller value.

18 Claims, 11 Drawing Sheets

U.S. PATENT DOCUMENTS

| | | | | |
|---|---|---|---|---|
| 5,867,814 | A * | 2/1999 | Yong | 704/216 |
| 6,014,618 | A * | 1/2000 | Patel et al. | 704/207 |
| 6,148,282 | A * | 11/2000 | Paksoy et al. | 704/219 |
| 6,173,257 | B1 * | 1/2001 | Gao | 704/220 |
| 6,385,573 | B1 * | 5/2002 | Gao et al. | 704/220 |
| 6,415,254 | B1 * | 7/2002 | Yasunaga et al. | 704/223 |
| 6,507,814 | B1 * | 1/2003 | Gao | 704/220 |
| 6,556,966 | B1 * | 4/2003 | Gao | 704/220 |
| 6,823,303 | B1 * | 11/2004 | Su et al. | 704/220 |
| 7,013,268 | B1 * | 3/2006 | Gao | 704/219 |
| 7,092,885 | B1 | 8/2006 | Yamaura | |

FOREIGN PATENT DOCUMENTS

| | | | |
|---|---|---|---|
| JP | 5-108098 | A | 4/1993 |
| JP | 5-265496 | A | 10/1993 |
| JP | 5-273999 | A | 10/1993 |
| JP | 7-44200 | A | 2/1995 |
| JP | 8-6600 | A | 1/1996 |
| JP | 11-327597 | A | 11/1999 |
| WO | WO-92/06470 | A1 | 4/1992 |
| WO | WO-00/11658 | A1 | 3/2000 |

OTHER PUBLICATIONS

Adoul et al. "Fast CELP coding based on algebraic codes" Apr. 1997, IEEE International Conference on Acoustics, Speech, and Signal Processing, vol. 12, pp. 1957-1960.*

Laflamme et al. "On reducing computational complexity of codebook search in CELP coder through the use of algebraic codes", Acoustic, Speech, and Signal processing, 1990, ICASSP-90, International Conference; Apr. 3-6, 1990; vol. 1, pp. 177-180.*

Meyer, P; "Design and evaluation of optimal cepstral lifters for accessing⌈⌉articulatory codebooks"; 1991; AT&T Bell Labs., Murray Hill, NJ, USA; IEEE Transactions on Signal Processing, v39, n7, pp. 1493-1502, 1991.*

Ehara et al., "An Improved Low Bit-rate ACELP Speech Coding", Information ANS System 1 of the Proceeding of the 1999 IEICE General Conference of the Institute of Electronics, Information and Communication Engineers of Japan, p. 227, (1999).

* cited by examiner

PRIOR ART

PRIOR ART

SPEECH ENCODING SYSTEM, AND SPEECH ENCODING METHOD

This application is the national phase under 35 U.S.C. § 371 of PCT International Application No. PCT/JP01/03659 which has an International filing date of Apr. 26, 2001, which designated the United States of America.

TECHNICAL FIELD

The present invention relates to a speech encoding apparatus and speech encoding method for compressing a digital speech signal to a smaller amount of information.

BACKGROUND ART

A number of conventional speech encoding apparatuses generate speech codes by separating input speech into spectrum envelope information and sound source information, and by encoding them frame by frame with a specified length. The most typical speech encoding apparatuses are those that use a CELP (Code Excited Linear Prediction) scheme.

FIG. 1 is a block diagram showing a configuration of a conventional CELP speech encoding apparatus. In FIG. 1, the reference numeral 1 designates a linear prediction analyzer for analyzing the input speech to extract linear prediction coefficients constituting the spectrum envelope information of the input speech. The reference numeral 2 designates a linear prediction coefficient encoder for encoding the linear prediction coefficients the linear prediction analyzer 1 extracts, and for supplying the encoding result to a multiplexer 6. It also supplies the quantized values of the linear prediction coefficients to an adaptive excitation encoder 3, fixed excitation encoder 4 and gain encoder 5.

The reference numeral 3 designates the adaptive excitation encoder for generating temporary synthesized speech using the quantized values of the linear prediction coefficients the linear prediction coefficient encoder 2 outputs. It selects adaptive excitation code that will minimize the distance between the temporary synthesized speech and input speech and supplies it to the multiplexer 6. It also supplies the gain encoder 5 with an adaptive excitation signal (time series vectors formed by cyclically repeating the past excitation signal with a specified length) corresponding to the adaptive excitation code. The reference numeral 4 designates the fixed excitation encoder for generating temporary synthesized speech using the quantized values of the linear prediction coefficients the linear prediction coefficient encoder 2 outputs. It selects the fixed excitation code that will minimize the distance between the temporary synthesized speech and a target signal to be encoded (signal obtained by subtracting the synthesized speech based on the adaptive excitation signal from the input speech), and supplies it to the multiplexer 6. It also supplies the gain encoder 5 with the fixed excitation signal consisting of the time series vectors corresponding to the fixed excitation code.

The reference numeral 5 designates a gain encoder for generating a excitation signal by multiplying the adaptive excitation signal the adaptive excitation encoder 3 outputs and the fixed excitation signal the fixed excitation encoder 4 outputs by the individual elements of gain vectors, and by summing up the products of the multiplications. It also generates temporary synthesized speech from the excitation signal using the quantized values of the linear prediction coefficients the linear prediction coefficient encoder 2 outputs. Then, it selects the gain code that will minimize the distance between the temporary synthesized speech and input speech, and supplies it to the multiplexer 6. The reference numeral 6 designates the multiplexer for outputting the speech code by multiplexing the code of the linear prediction coefficients the linear prediction coefficient encoder 2 encodes, the adaptive excitation code the adaptive excitation encoder 3 outputs, the fixed excitation code the fixed excitation encoder 4 outputs and the gain code the gain encoder 5 outputs.

FIG. 2 a block diagram showing an internal configuration of the fixed excitation encoder 4. In FIG. 2, the reference numeral 11 designates a fixed excitation codebook, 12 designates a synthesis filter, 13 designates a distortion calculator and 14 designates a distortion estimator.

Next, the operation will be described.

The conventional speech encoding apparatus carries out its processing frame by frame with a length of about 5-50 ms.

First, encoding of the spectrum envelope information will be described.

Receiving the input speech, the linear prediction analyzer 1 analyzes the input speech to extract the linear prediction coefficients constituting the spectrum envelope information of the speech.

When the linear prediction analyzer 1 extracts the linear prediction coefficients, the linear prediction coefficient encoder 2 encodes the linear prediction coefficients, and supplies the code to the multiplexer 6. In addition, it supplies the quantized values of the linear prediction coefficients to the adaptive excitation encoder 3, fixed excitation encoder 4 and gain encoder 5.

Next, encoding of the sound source information will be described.

The adaptive excitation encoder 3 includes an adaptive excitation codebook for storing past excitation signals with a specified length. It generates the time series vectors by cyclically repeating the past excitation signals in response to the internally generated adaptive excitation codes, each of which is represented by a few bit binary number.

Subsequently, the adaptive excitation encoder 3 multiplies the individual time series vectors by an appropriate gain factor. Then, it generates the temporary synthesized speech by passing the individual time series vectors through a synthesis filter that uses the quantized values of the linear prediction coefficients the linear prediction coefficient encoder 2 outputs.

The adaptive excitation encoder 3 further detects as the encoding distortion, the distance between the temporary synthesized speech and the input speech, for example, selects the adaptive excitation code that will minimize the distance, and supplies it to the multiplexer 6. At the same time, it supplies the gain encoder 5 with a time series vector corresponding to the adaptive excitation code as the adaptive excitation signal.

In addition, the adaptive excitation encoder 3 supplies the fixed excitation encoder 4 with the signal which is obtained by subtracting the synthesized speech based on the adaptive excitation signal from the input speech, as the target signal to be encoded.

Next, the operation of the fixed excitation encoder 4 will be described.

The fixed excitation codebook 11 of the fixed excitation encoder 4 stores the fixed code vectors consisting of multiple noise-like time series vectors. It sequentially outputs the time series vectors in response to the individual fixed excitation codes which are each represented by a few-bit binary number output from the distortion estimator 14. The individual time series vectors are multiplied by an appropriate gain factor, and supplied to the synthesis filter 12.

The synthesis filter 12 generates a temporary synthesized speech composed of the gain-multiplied individual time series vectors using the quantized values of the linear prediction coefficients the linear prediction coefficient encoder 2 outputs.

The distortion calculator 13 calculates as the encoding distortion, the distance between the temporary synthesized speech and the target signal to be encoded the adaptive excitation encoder 3 outputs, for example.

The distortion estimator 14 selects the fixed excitation code that will minimize the distance between the temporary synthesized speech and the target signal to be encoded the distortion Calculator 13 calculates, and supplies it to the multiplexer 6. It also provides the fixed excitation codebook 11 with an instruction to supply the time series vector corresponding to the selected fixed excitation code to the gain encoder 5 as the fixed excitation signal.

The gain encoder 5 includes a gain codebook for storing gain vectors, and sequentially reads the gain vectors from the gain codebook in response to the internally generated gain codes, each of which is represented by a few-bit binary number.

Subsequently, the gain encoder 5 generates the excitation signal by multiplying the adaptive excitation signal the adaptive excitation encoder 3 outputs and the fixed excitation signal the fixed excitation encoder 4 outputs by the elements of the individual gain vectors, and by summing up the resultant products of the multiplications.

Then, the excitation signal is passed through a synthesis filter using the quantized values of the linear prediction coefficients the linear prediction coefficient encoder 2 outputs, to generate temporary synthesized speech.

Subsequently, the gain encoder 5 detects as the encoding distortion, the distance between the temporary synthesized speech and the input speech, for example, selects the gain code that will minimize the distance, and supplies it to the multiplexer 6. In addition, the gain encoder 5 supplies the excitation signal corresponding to the gain code to the adaptive excitation encoder 3. In response to the excitation signal corresponding to the gain code the gain encoder 5 selects, the adaptive excitation encoder 3 updates its adaptive excitation codebook.

The multiplexer 6 multiplexes the linear prediction coefficients the linear prediction coefficient encoder 2 encodes, the adaptive excitation code the adaptive excitation encoder 3 outputs, the fixed excitation code the fixed excitation encoder 4 outputs, and the gain code the gain encoder 5 outputs, thereby outputting the multiplexing result as the speech code.

Next, a conventional technique that improves the foregoing CELP speech encoding apparatus will be described.

Japanese patent application laid-open No. 5-108098/1993 (Reference 1), and Ehara et al., "An Improved Low Bit-rate ACELP Speech Coding", page 1,227 of Information and System 1 of the Proceeding of the 1999 IEICE General Conference of the Institute of Electronics, Information and Communication Engineers of Japan, (Reference 2) each disclose a CELP speech encoding apparatus that includes fixed excitation codebooks as multiple fixed excitation generators, for the purpose of providing high-quality speech even at a low bit rate. These conventional configurations include a fixed excitation codebook for generating a plurality of noise-like time series vectors and a fixed excitation codebook for generating a plurality of non-noise-like (pulse-like) time series vectors.

The non-noise-like time series vectors are time series vectors consisting of a pulse train with a pitch period in the Reference 1, and time series vectors with an algebraic excitation structure consisting of a small number of pulses in the Reference 2.

FIG. 3 is a block diagram showing an internal configuration of the fixed excitation encoder 4 including a plurality of fixed excitation codebooks. The speech encoding apparatus has the same configuration as that of FIG. 1 except for the fixed excitation encoder 4.

In FIG. 3, the reference numeral 21 designates a first fixed excitation codebook for storing multiple noise-like time series vectors; 22 designates a first synthesis filter; 23 designates a first distortion calculator; 24 designates a second fixed excitation codebook for storing multiple non-noise-like time series vectors; 25 designates a second synthesis filter; 26 designates a second distortion calculator; and 27 designates a distortion estimator.

Next, the operation will be described.

The first fixed excitation codebook 21 stores the fixed code vectors consisting of the multiple noise-like time series vectors, and sequentially outputs the time series vectors in response to the individual fixed excitation codes the distortion estimator 27 outputs. Subsequently, the individual time series vectors are multiplied by an appropriate gain factor and supplied to the first synthesis filter 22.

The first synthesis filter 22 generates temporary synthesized speech corresponding to the gain-multiplied individual time series vectors using the quantized values of the linear prediction coefficients the linear prediction coefficient encoder 2 outputs.

The first distortion calculator 23 calculates as the encoding distortion, the distance between the temporary synthesized speech and the target signal to be encoded the adaptive excitation encoder 3 outputs, and supplies it to the distortion estimator 27.

On the other hand, the second fixed excitation codebook 24 stores the fixed code vectors consisting of the multiple non-noise-like time series vectors, and sequentially outputs the time series vectors in response to the individual fixed excitation code the distortion estimator 27 outputs. Subsequently, the individual time series vectors are multiplied by an appropriate gain factor, and supplied to the second synthesis filter 25.

The second synthesis filter 25 generates temporary synthesized speech corresponding to the gain-multiplied individual time series vectors using the quantized values of the linear prediction coefficients the linear prediction coefficient encoder 2 outputs.

The second distortion calculator 26 calculates as the encoding distortion, the distance between the temporary synthesized speech and the target signal to be encoded the adaptive excitation encoder 3 outputs, and supplies it to the distortion estimator 27.

The distortion estimator 27 selects the fixed excitation code that will minimize the distance between the temporary synthesized speech and the target signal to be encoded, and supplies it to the multiplexer 6. It also provides the first fixed excitation codebook 21 or second fixed excitation codebook 24 with an instruction to supply the gain encoder 5 with the time series vectors corresponding to the selected fixed excitation code as the fixed excitation signal.

Japanese patent application laid-open No. 5-273999/1993 (Reference 3) discloses the following method in the configuration including the multiple fixed excitation codebooks. To prevent the fixed excitation codebooks from being switched frequently in steady sections of vowels and the like, it categorizes the input speech according to its acoustic characteristics, and reflects the resultant categories in the distortion evaluation for selecting the fixed excitation code.

With the foregoing configurations, the conventional speech encoding apparatuses each include multiple fixed excitation codebooks including different types of time series vectors to be generated, and select time series vectors that will give the minimum distance between the temporary synthesized speech generated from the individual time series vectors and the target signal to be encoded (see, FIG. 3). Here, the non-noise-like (pulse-like) time series vectors are likely to have a smaller distance between the temporary synthesized speech and the target signal to be encoded than the noise-like time series vectors, and hence to be selected more frequently.

However, when the non-noise-like (pulse-like) time series vectors are selected frequently, the sound quality also becomes pulse-like quality, offering a problem in that a subjective sound quality is not always best.

In addition, in the sections where the target signal to be encoded or input speech has noise-like quality, there arise a problem in that the subjective degradation of the sound quality becomes conspicuous due to the pulse-like characteristic resulting from frequent selecting non-noise-like (pulse-like) time series vectors.

Furthermore, when the apparatus includes multiple fixed excitation codebooks, the ratios the individual fixed excitation codebooks are selected depend on the number of the time series vectors the individual fixed excitation codebooks generate, and the fixed excitation codebooks having a larger number of time series vectors to be selected are likely to be selected more often.

Thus, it will be possible to achieve the best subjective quality by adjusting the ratios the individual fixed excitation codebooks are selected by varying the number of the time series vectors the individual fixed excitation codebooks generate.

However, even if the number of the time series vectors to be generated are the same, different configurations of the individual fixed excitation codebooks will require different memory capacities and processing loads of encoding. For example, when using the fixed excitation codebook for generating a pulse train with a pitch period, both the memory capacity and processing load are very small. In contrast, when using the time series vectors that are obtained through distortion minimization learning for the speech by storing them, both the memory capacity and processing load are large. Accordingly, the number of the time series vectors the individual fixed excitation codebooks can generate is restricted by the scale and performance of hardware that implements the speech coding scheme. Consequently, the ratios the individual fixed excitation codebooks are selected cannot be optimized, offering a problem in that the subjective quality is not always best.

Japanese patent application laid-open No. 5-273999/1993 (Reference 3) can circumvent the frequent switching of the fixed excitation codebooks to be selected in the steady sections of the vowels. However, it does not try to improve the subjective quality of the encoding result of the individual frames. On the contrary, it has a problem of degrading the subjective quality because of successive pulse-like sound sources.

Moreover, the foregoing problems are not solved at all when the target signal to be encoded or the input speech has noise-like quality, or the hardware has restrictions.

The present invention is implemented to solve the foregoing problems. Therefore, an object of the present invention is to provide a speech encoding apparatus and speech encoding method capable of obtaining subjectively high-quality speech code by making effective use of the multiple fixed excitation codebooks.

DISCLOSURE OF THE INVENTION

A speech encoding apparatus in accordance with the present invention is configured such that when a sound source information encoder selects a fixed excitation code, it calculates encoding distortion of a noise-like fixed code vector and multiplies the encoding distortion by a fixed weight corresponding to the noise-like degree of the noise-like fixed code vector, calculates the encoding distortion of a non-noise-like fixed code vector and multiplies the encoding distortion by a fixed weight corresponding to the non-noise-like fixed code vector, and selects the fixed excitation code associated with multiplication result with a smaller value.

Thus, it offers an advantage of being able to produce subjectively high-quality speech code by making efficient use of multiple fixed excitation codebooks.

The speech encoding apparatus in accordance with the present invention can be configured such that the sound source information encoder uses the noise-like fixed code vector and the non-noise-like fixed code vector with different noise-like degrees.

Thus, it offers an advantage of being able to produce subjectively high-quality speech code by alleviating the degradation that the sound becomes pulse-like quality.

The speech encoding apparatus in accordance with the present invention can be configured such that the sound source information encoder varies the weights in accordance with the noise-like degree of a target signal to be encoded.

Thus, it offers an advantage of being able to produce subjectively high-quality speech code by alleviating the degradation that the sound becomes pulse-like quality.

The speech encoding apparatus in accordance with the present invention can be configured such that the sound source information encoder varies the weights in accordance with the noise-like degree of the input speech.

Thus, it offers an advantage of being able to produce subjectively high-quality speech code by alleviating the degradation that the sound becomes pulse-like quality.

The speech encoding apparatus in accordance with the present invention can be configured such that the sound source information encoder varies the weights in accordance with the noise-like degree of a target signal to be encoded and that of the input speech.

Thus, it offers an advantage of being able to further improve the sound quality by enabling higher level control of the weights.

The speech encoding apparatus in accordance with the present invention is configured such that the sound source information encoder determines weights considering a number of fixed code vectors stored in each fixed excitation codebook.

Thus, it offers an advantage of being able to produce subjectively high-quality speech code without being affected by the scale and performance of hardware.

A speech encoding method in accordance with the present invention includes, when selecting a fixed excitation code, the steps of calculating the encoding distortion of a noise-like fixed code vector; multiplying the encoding distortion by a fixed weight corresponding to the noise-like degree of the noise-like fixed code vector; calculating the encoding distortion of a non-noise-like fixed code vector; multiplying the encoding distortion by a fixed weight corresponding to the non-noise-like fixed code vector; and selecting the fixed excitation code associated with multiplication result with a smaller value.

Thus, it offers an advantage of being able to produce subjectively high-quality speech code by making efficient use of multiple fixed excitation codebooks.

The speech encoding method in accordance with the present invention can use the noise-like fixed code vector and the non-noise-like fixed code vector with different noise-like degrees.

Thus, it offers an advantage of being able to produce subjectively high-quality speech code by alleviating the degradation that the sound becomes pulse-like quality.

The speech encoding method in accordance with the present invention can vary the weights in accordance with the noise-like degree of a target signal to be encoded.

Thus, it offers an advantage of being able to produce subjectively high-quality speech code by alleviating the degradation that the sound becomes pulse-like quality.

The speech encoding method in accordance with the present invention can vary the weights in accordance with the noise-like degree of the input speech.

Thus, it offers an advantage of being able to produce subjectively high-quality speech code by alleviating the degradation that the sound becomes pulse-like quality.

The speech encoding method in accordance with the present invention can vary the weights in accordance with the noise-like degree of a target signal to be encoded and that of the input speech.

Thus, it offers an advantage of being able to further improve the sound quality by enabling higher level control of the weights.

The speech encoding method in accordance with the present invention determines weights considering a number of fixed code vectors stored in each fixed excitation codebook.

Thus, it offers an advantage of being able to produce subjectively high-quality speech code without being affected by the scale and performance of hardware.

BEST MODE FOR CARRYING OUT THE INVENTION

The best mode for carrying out the present invention will now be described with reference to the accompanying drawings.

EMBODIMENT 1

Figure 1:
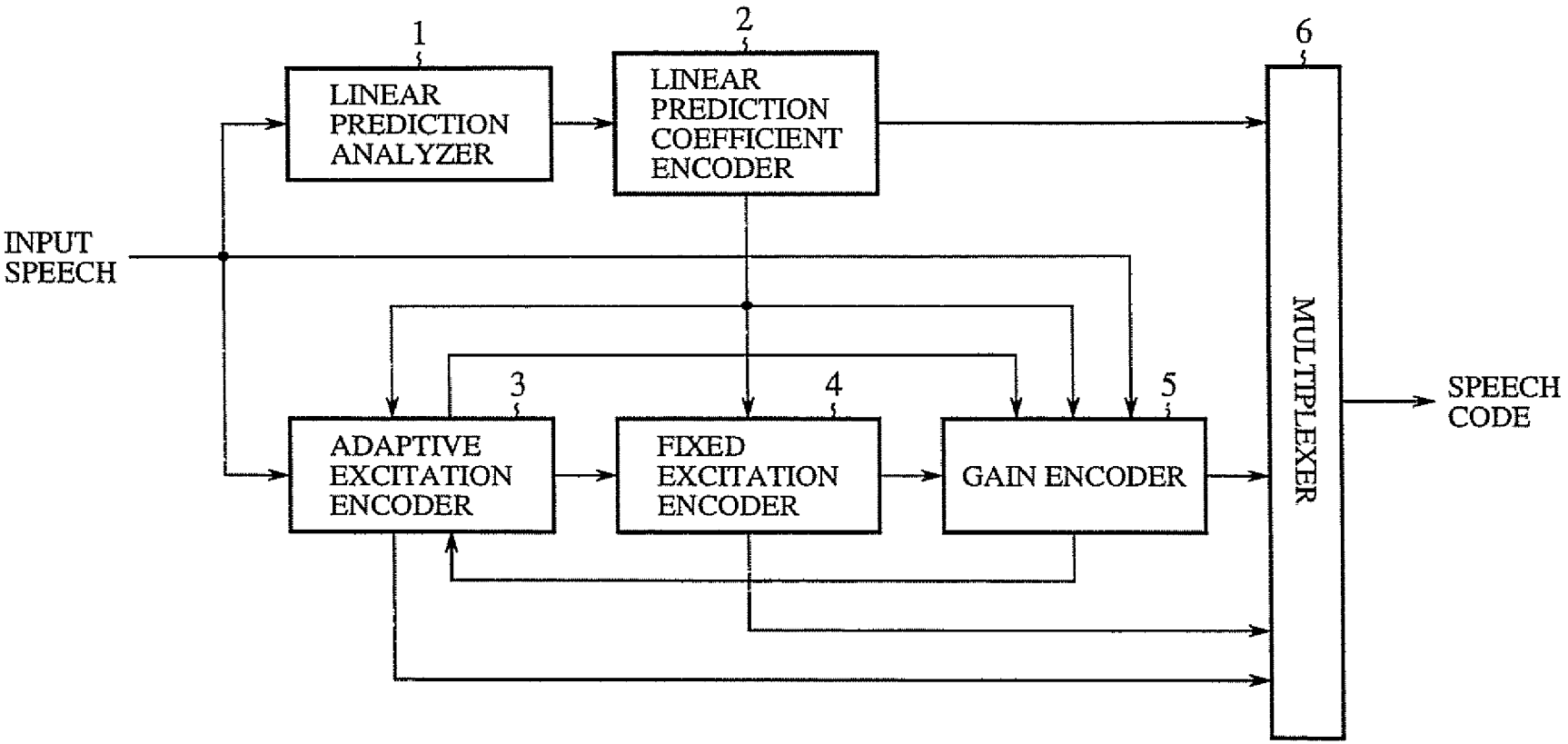
FIG. 1 is a block diagram showing a configuration of a conventional CELP speech encoding apparatus.
Figure 2:
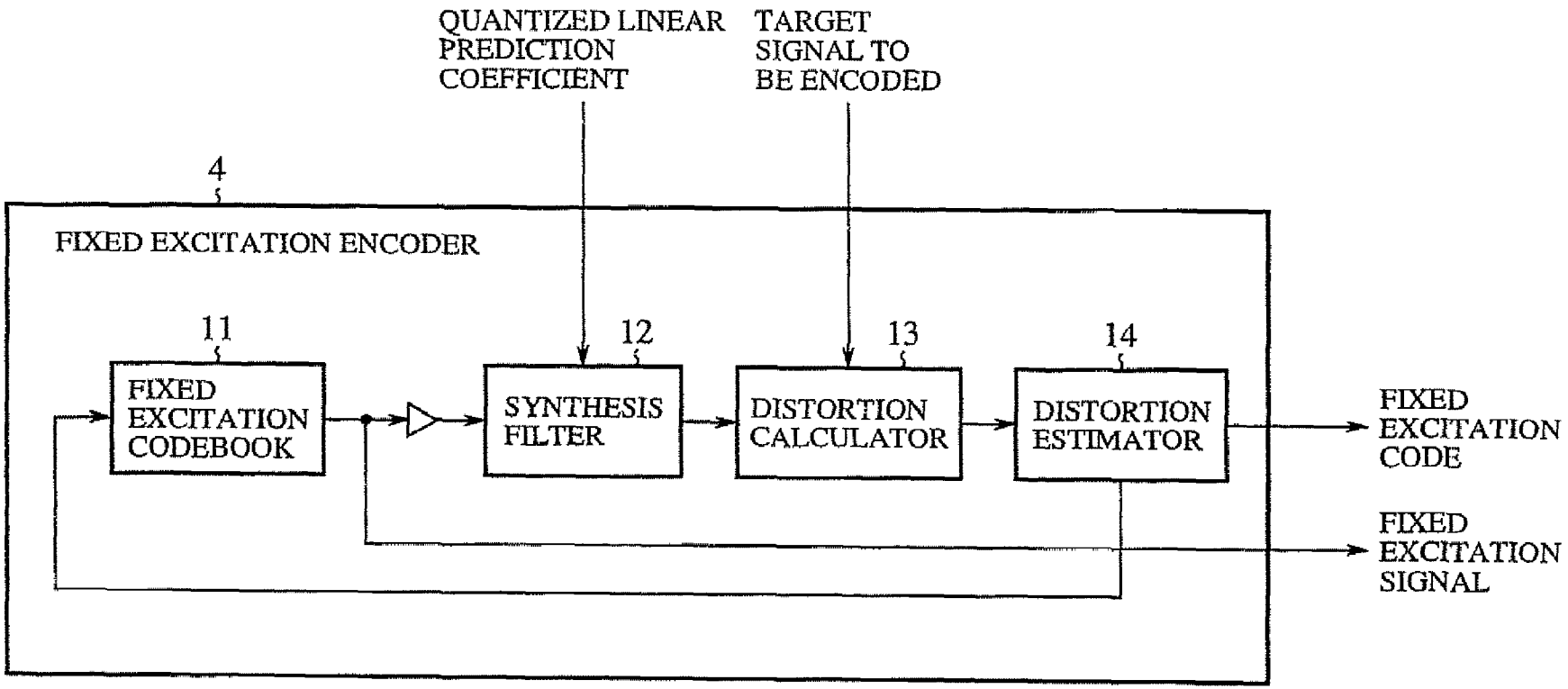
FIG. 2 is a block diagram showing an internal configuration of a fixed excitation encoder 4.
Figure 3:
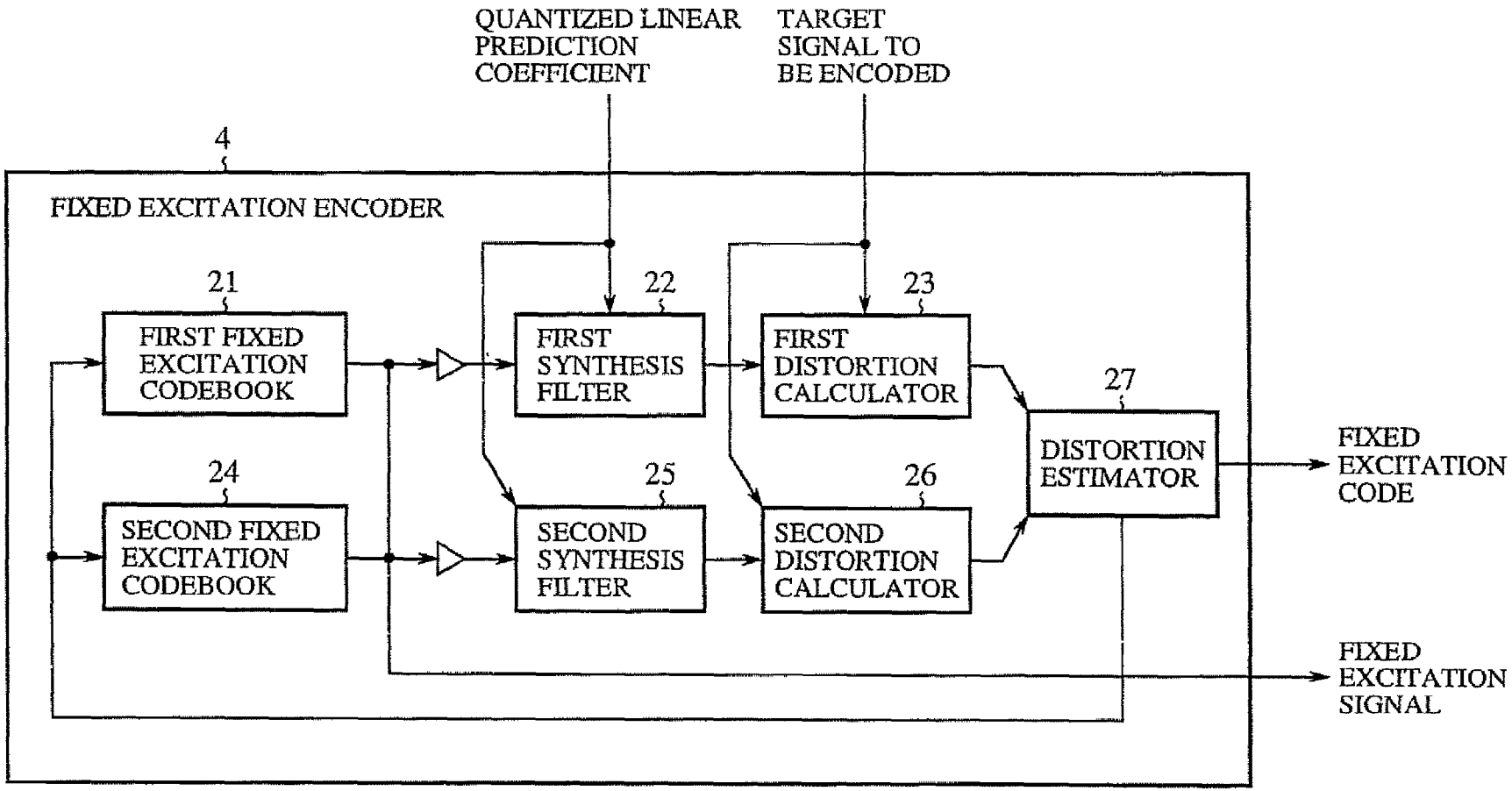
FIG.3 PRIOR ART
FIG. 3 is a block diagram showing an internal configuration of a fixed excitation encoder 4 including multiple fixed excitation codebooks.
Figure 4:
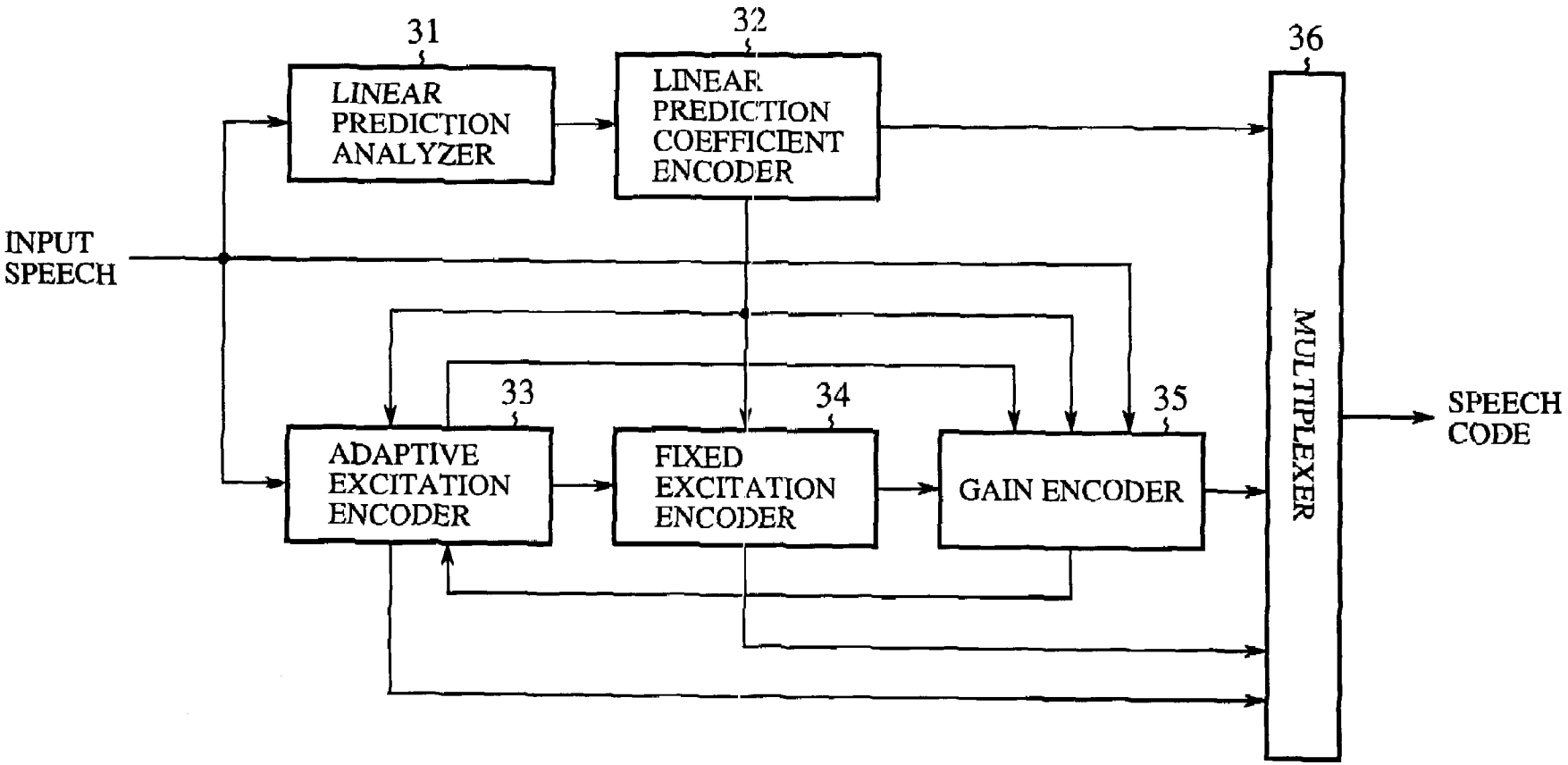
FIG. 4 is a block diagram showing a configuration of an embodiment 1 of the speech encoding apparatus in accordance with the present invention.

FIG. 4 is a block diagram showing a configuration of an embodiment 1 of the speech encoding apparatus in accordance with the present invention. In FIG. 4, the reference numeral 31 designates a linear prediction analyzer for analyzing the input speech to extract linear prediction coefficients constituting the spectrum envelope information of the input speech. The reference numeral 32 designates a linear prediction coefficient encoder for encoding the linear prediction coefficients the linear prediction analyzer 31 extracts, and for supplying the encoding result to a multiplexer 36. It also supplies the quantized values of the linear prediction coefficients to an adaptive excitation encoder 33, fixed excitation encoder 34 and gain encoder 35.

Here, the linear prediction analyzer 31 and linear prediction coefficient encoder 32 constitute an envelope information encoder.

The reference numeral 33 designates the adaptive excitation encoder for generating temporary synthesized speech using the quantized values of the linear prediction coefficients the linear prediction coefficient encoder 32 outputs. It selects the adaptive excitation code that will minimize the distance between the temporary synthesized speech and input speech, and supplies it to the multiplexer 36. It also supplies the gain encoder 35 with an adaptive excitation signal (time series vectors formed by cyclically repeating the past excitation signal with a specified length) corresponding to the adaptive excitation code. The reference numeral 34 designates the fixed excitation encoder for generating temporary synthesized speech using the quantized values of the linear prediction coefficients the linear prediction coefficient encoder 32 outputs. It selects the fixed excitation code that will minimize the distance between the temporary synthesized speech and a target signal to be encoded (signal obtained by subtracting the synthesized speech based on the adaptive excitation signal from the input speech), and supplies it to the multiplexer 36. It also supplies the fixed excitation signal consisting of the time series vectors corresponding to the fixed excitation code to the gain encoder 35.

The reference numeral 35 designates a gain encoder for generating a excitation signal by multiplying the adaptive excitation signal the adaptive excitation encoder 33 outputs and the fixed excitation signal the fixed excitation encoder 34 outputs by the individual elements of the gain vectors, and by summing up the resultant products of the multiplications. It also generates temporary synthesized speech from the excitation signal using the quantized values of the linear prediction coefficients the linear prediction coefficient encoder 32 outputs. Then, it selects the gain code that will minimize the distance between the temporary synthesized speech and input speech, and supplies it to the multiplexer 36.

Here, the adaptive excitation encoder 33, fixed excitation encoder 34 and gain encoder 35 constitute a sound source information encoder.

The reference numeral 36 designates the multiplexer that outputs the speech code by multiplexing the code of the linear prediction coefficients the linear prediction coefficient encoder 32 encodes, the adaptive excitation code the adaptive excitation encoder 33 outputs, the fixed excitation code the fixed excitation encoder 34 outputs and the gain code the gain encoder 35 outputs.

Figure 5:
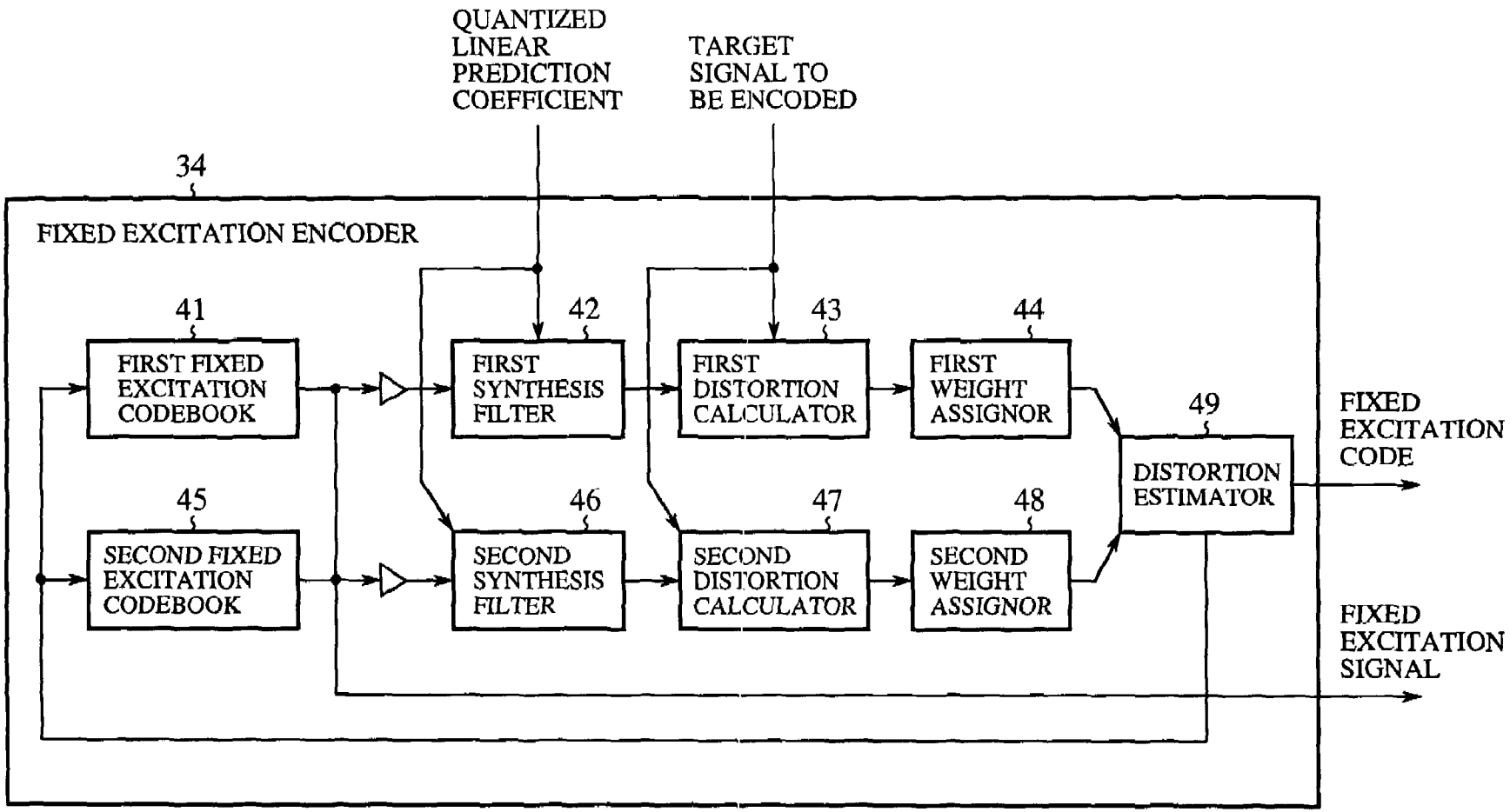
FIG. 5 is a block diagram showing an internal configuration of a fixed excitation encoder 34.

FIG. 5 is a block diagram showing an internal configuration of the fixed excitation encoder 34. In FIG. 5, the reference numeral 41 designates a first fixed excitation codebook constituting a fixed excitation generator for storing multiple noise-like time series vectors (fixed code vectors); 42 designates a first synthesis filter for generating the temporary synthesized speech based on the individual time series vectors using the quantized values of the linear prediction coefficients the linear prediction coefficient encoder 32 outputs; 43 designates a first distortion calculator for calculating the distance between the temporary synthesized speech and the target signal to be encoded the adaptive excitation encoder 33 outputs; and 44 designates a first weight assignor for multiplying the calculation result of the first distortion calculator 43 by a fixed weight corresponding to the noise-like degree of the time series vectors.

The reference numeral 45 designates a second fixed excitation codebook constituting a fixed excitation generator for storing multiple non-noise-like time series vectors (fixed code vectors); 46 designates a second synthesis filter for generating temporary synthesized speech based on the individual time series vectors using the quantized values of the linear prediction coefficients the linear prediction coefficient encoder 32 outputs; 47 designates a second distortion calculator for calculating the distance between the temporary synthesized speech and the target signal to be encoded the adaptive excitation encoder 33 outputs; 48 designates a second weight assignor for multiplying the calculation result of the second distortion calculator 47 by a fixed weight corresponding to the noise-like degree of the time series vectors; and 49 designates a distortion estimator for selecting the fixed excitation code associated with a smaller one of the multiplication results output from the first weight assignor 44 and second weight assignor 48.

Figure 6:
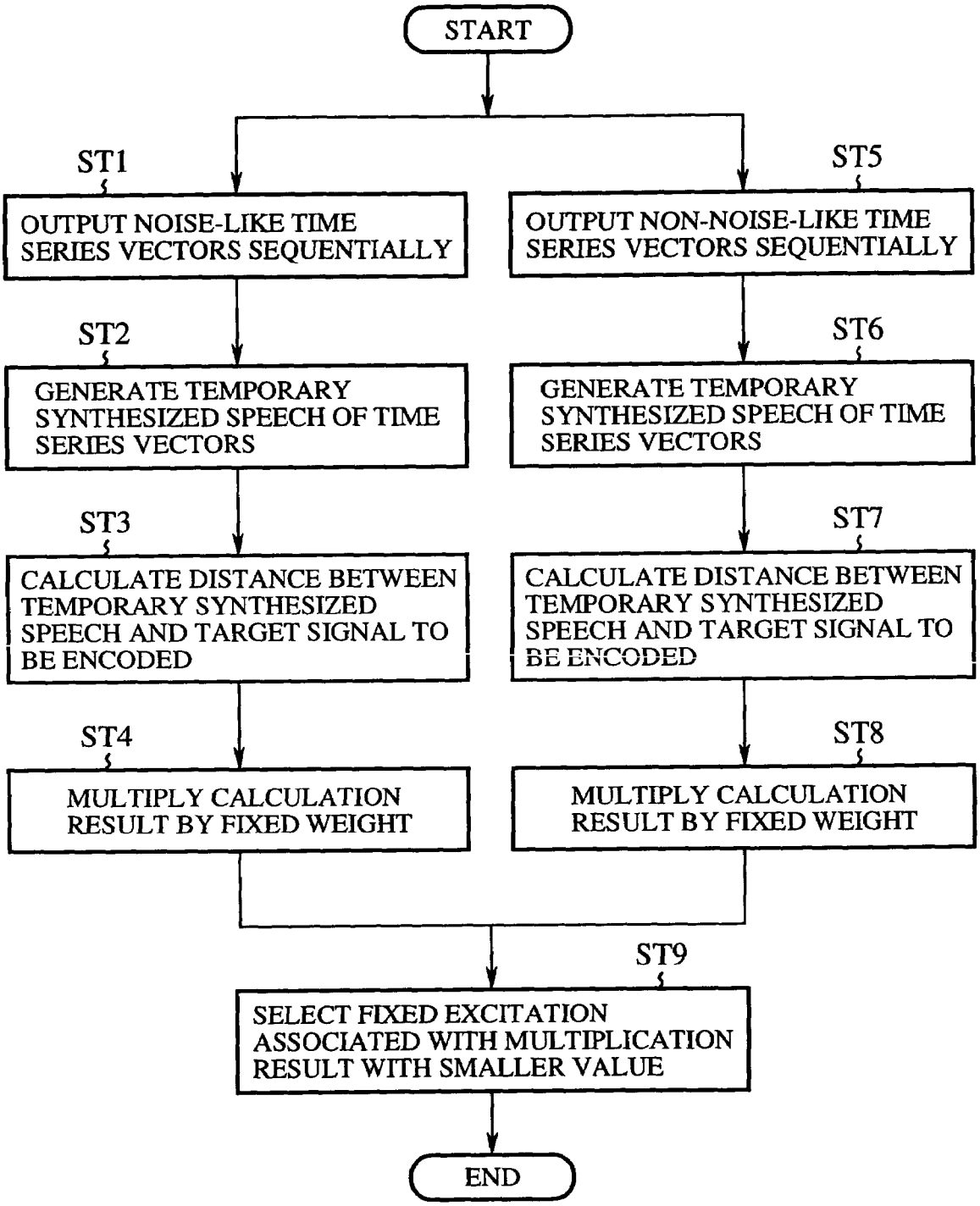
FIG. 6 is a flowchart illustrating the processing of the fixed excitation encoder 34.

FIG. 6 is a flowchart illustrating the processing of the fixed excitation encoder 34.

Next, the operation will be described.

The speech encoding apparatus carries out its processing frame by frame with a length of about 5-50 ms.

First, encoding of the spectrum envelope information will be described.

Receiving the input speech, the linear prediction analyzer 31 analyzes the input speech to extract the linear prediction coefficients constituting the spectrum envelope information of the speech.

When the linear prediction analyzer 31 extracts the linear prediction coefficients, the linear prediction coefficient encoder 32 encodes the linear prediction coefficients, and supplies the code to the multiplexer 36. In addition, it supplies the quantized values of the linear prediction coefficients to the adaptive excitation encoder 33, fixed excitation encoder 34 and gain encoder 35.

Next, encoding of the sound source information will be described.

The adaptive excitation encoder 33 includes an adaptive excitation codebook for storing past excitation signals with a specified length. It generates the time series vectors by cyclically repeating the past excitation signals in response to internally generated adaptive excitation codes, each of which is represented by a few bit binary number.

Subsequently, the adaptive excitation encoder 33 multiplies the individual time series vectors by an appropriate gain factor. Then, it generates temporary synthesized speech by passing the individual time series vectors through a synthesis filter that uses the quantized values of the linear prediction coefficients the linear prediction coefficient encoder 32 outputs.

The adaptive excitation encoder 33 further detects as the encoding distortion, the distance between the temporary synthesized speech and the input speech, for example, selects the adaptive excitation code that will minimize the distance, and supplies it to the multiplexer 36. At the same time, it supplies the gain encoder 35 with the time series vector corresponding to the adaptive excitation code as the adaptive excitation signal.

In addition, the adaptive excitation encoder 33 supplies the fixed excitation encoder 34 with a signal that is obtained by subtracting the synthesized speech based on the adaptive excitation signal from the input speech, as the target signal to be encoded.

Next, the operation of the fixed excitation encoder 34 will be described.

The first fixed excitation codebook 41 stores the fixed code vectors consisting of multiple noise-like time series vectors, and sequentially produces the time series vectors in response to the individual fixed excitation codes the distortion estimator 49 outputs (step ST1). Subsequently, the individual time series vectors are multiplied by an appropriate gain factor, and are supplied to the first synthesis filter 42.

The first synthesis filter 42 generates temporary synthesized speech based on the gain-multiplied individual time series vectors using the quantized values of the linear prediction coefficients the linear prediction coefficient encoder 32 outputs (step ST2).

The first distortion calculator 43 calculates as the encoding distortion, the distance between the temporary synthesized speech and the target signal to be encoded the adaptive excitation encoder 33 outputs, for example (step ST3).

The first weight assignor 44 multiplies the calculation result of the first distortion calculator 43 by the fixed weight that is preset in accordance with the noise-like degree of the time series vectors the first fixed excitation codebook 41 stores (step ST4).

On the other hand, the second fixed excitation codebook 45 stores the fixed code vectors consisting of multiple non-noise-like time series vectors, and sequentially outputs the time series vectors in response to the individual fixed excitation codes the distortion estimator 49 outputs (step ST5) Subsequently, the individual time series vectors are multiplied by an appropriate gain factor, and are supplied to the second synthesis filter 46.

The second synthesis filter 46 generates the temporary synthesized speech based on the gain-multiplied individual time series vectors using the quantized values of the linear prediction coefficients the linear prediction coefficient encoder 32 outputs (step ST6).

The second distortion calculator 47 calculates as the encoding distortion, the distance between the temporary synthesized speech and the target signal to be encoded the adaptive excitation encoder 33 outputs, for example (step ST7).

The second weight assignor 48 multiplies the calculation result of the second distortion calculator 47 by the fixed weight that is preset in accordance with the noise-like degree of the time series vectors the second fixed excitation codebook 45 stores (step ST8).

The distortion estimator 49 selects the fixed excitation code that will minimize the distance between the temporary synthesized speech and the target signal to be encoded. Specifically, it selects the fixed excitation code associated with a smaller one of the multiplication results of the first weight assignor 44 and second weight assignor 48 (step ST9). It also provides the first fixed excitation codebook 41 or second fixed excitation codebook 45 with an instruction to supply the time series vector corresponding to the selected fixed excitation code to the gain encoder 35 as the fixed excitation signal.

Here, the fixed weights the first weight assignor 44 and second weight assignor 48 utilize are preset in accordance with the noise-like degrees of the time series vectors stored in their corresponding fixed excitation codebooks.

Next, a setting method of the weights for the fixed excitation codebooks will be described.

First, the noise-like degrees of the individual time series vectors in the fixed excitation codebooks are obtained. The noise-like degree is determined using physical parameters such as the number of zero-crossings, variance of the amplitude, temporal deviation of energy, the number of nonzero samples (the number of pulses) and phase characteristics.

Subsequently, the average value is calculated of all the noise-like degrees of the time series vectors the fixed excitation codebook stores. When the average value is large, a small weight is set, whereas when the average value is small, a large weight is set.

In other words, the first weight assignor 44, which corresponds to the first fixed excitation codebook 41 storing the noise-like time series vectors, sets the weight at a small value, and the second weight assignor 48, which corresponds to the second fixed excitation codebook 45 storing the non-noise-like time series vectors, sets the weight at a large value.

This facilitates selection of the noise-like time series vectors in the first fixed excitation codebook 41 as compared with the conventional case where no weighting is made. As a result, it becomes possible to reduce the degradation that the pulse-like sound quality results from selecting a lot of non-noise-like (pulse-like) time series vectors as in the conventional case.

When the fixed excitation encoder 34 outputs the fixed excitation signal as described above, the gain encoder 35, which includes a gain codebook for storing the gain vectors, sequentially reads the gain vectors from the gain codebook in response to internally generated gain codes, each of which is represented by a few-bit binary number.

Subsequently, the gain encoder 35 generates a excitation signal by multiplying the adaptive excitation signal the adaptive excitation encoder 33 outputs and the fixed excitation signal the fixed excitation encoder 34 outputs by the elements of the individual gain vectors, and by summing up the resultant products of the multiplications.

Then, the excitation signal is passed through a synthesis filter using the quantized values of the linear prediction coefficients the linear prediction coefficient encoder 32 outputs, to generate temporary synthesized speech.

Subsequently, the gain encoder 35 detects as the encoding distortion, the distance between the temporary synthesized speech and the input speech, for example, selects the gain code that will minimize the distance, and supplies it to the multiplexer 36. In addition, the gain encoder 35 supplies the excitation signal corresponding to the gain code to the adaptive excitation encoder 33. Thus, the adaptive excitation encoder 33 updates its adaptive excitation codebook using the excitation signal corresponding to the gain code the gain encoder 35 selects.

The multiplexer 36 multiplexes the linear prediction coefficients the linear prediction coefficient encoder 32 encodes, the adaptive excitation code the adaptive excitation encoder 33 outputs, the fixed excitation code the fixed excitation encoder 34 outputs, and the gain code the gain encoder 35 outputs, thereby outputting the multiplexing result as the speech code.

As described above, the present embodiment 1 is configured such that it includes a plurality of fixed excitation generators for generating fixed code vectors, and determines fixed weights for respective fixed excitation generators, that when selecting a fixed excitation code, it assigns weights to the encoding distortions of the fixed code vectors generated by the fixed excitation generators using the weights determined for the fixed excitation generators, and that it selects the fixed excitation code by comparing and estimating the weighted encoding distortions. Thus, the present embodiment 1 offers an advantage of being able to make efficient use of the first and second fixed excitation codebooks, and to obtain subjectively high-quality speech codes.

In addition, the present embodiment 1 is configured such that it determines the fixed weights for the respective individual fixed excitation generators in accordance with the noise-like degree of the fixed code vectors generated by the fixed excitation generator. Accordingly, it can reduce the undue selection of the non-noise-like (pulse-like) time series vectors. Consequently, it can alleviate the degradation that the sound becomes pulse-like quality, offering an advantage of being able to implement subjectively high-quality speech codes.

EMBODIMENT 2

Figure 7:
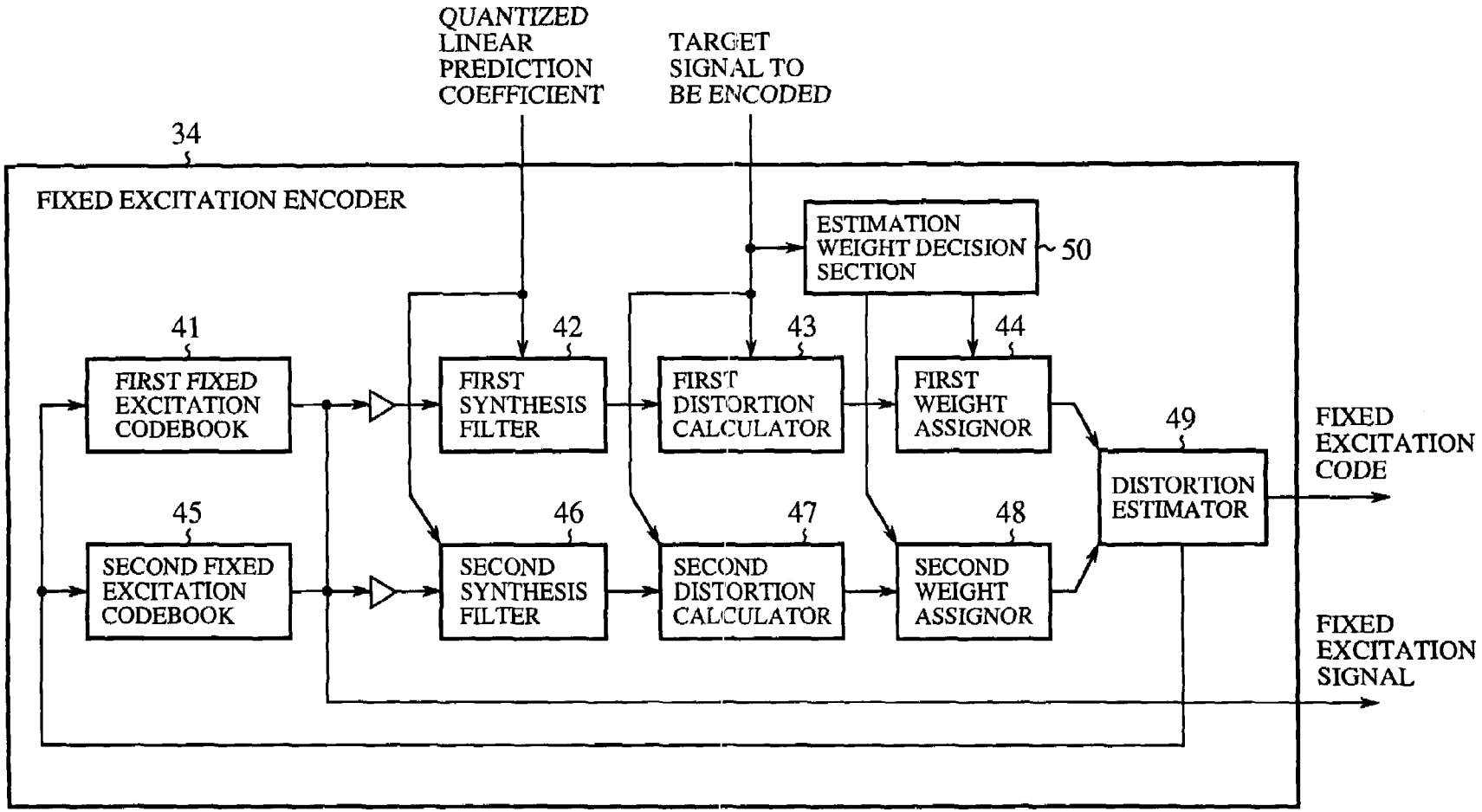
FIG. 7 is a block diagram showing an internal configuration of the fixed excitation encoder 34.

FIG. 7 is a block diagram showing an internal configuration of the fixed excitation encoder 34. In FIG. 7, the same reference numerals as those of FIG. 5 designate the same or like portions, and the description thereof is omitted here.

In FIG. 7, the reference numeral 50 designates an estimation weight decision section for varying weights in response to the noise-like degree of the target signal to be encoded.

Next, the operation will be described.

Since the present embodiment 2 is the same as the foregoing embodiment 1 except that it includes the additional estimation weight decision section 50 in the fixed excitation encoder 34, only the different operation will be described.

The estimation weight decision section 50 analyzes the target signal to be encoded, and determines the weights to be multiplied by the distances between the temporary synthesized speeches and the target signals to be encoded, which distances are output from the first distortion calculator 43 and second distortion calculator 47. Then, it supplies the weights to the first weight assignor 44 and second weight assignor 48.

The weights to be multiplied by the distances between temporary synthesized speeches and the target signals to be encoded are determined in accordance with the noise-like degree of the target signals to be encoded. In this case, when the noise-like degree of the target signal to be encoded is large, the weight assigned to the first fixed excitation codebook 41 with the greater noise-like degree is decreased, and the weight to be assigned to the second fixed excitation codebook 45 with the smaller noise-like degree is increased.

In other words, when the noise-like degree of the target signal to be encoded is large, the present embodiment 2 facilitates the selection of the (noise-like) time series vectors with the large noise-like degree.

Thus, it can reduce the degradation that the sound becomes pulse-like quality, which occurs in the conventional apparatus because of the frequent selection of the non-noise-like (pulse-like) time series vectors in sections in which the target signal to be encoded has noise-like quality. Consequently, the present embodiment 2 offers an advantage of being able to implement subjectively high-quality speech codes.

EMBODIMENT 3

Figure 8:
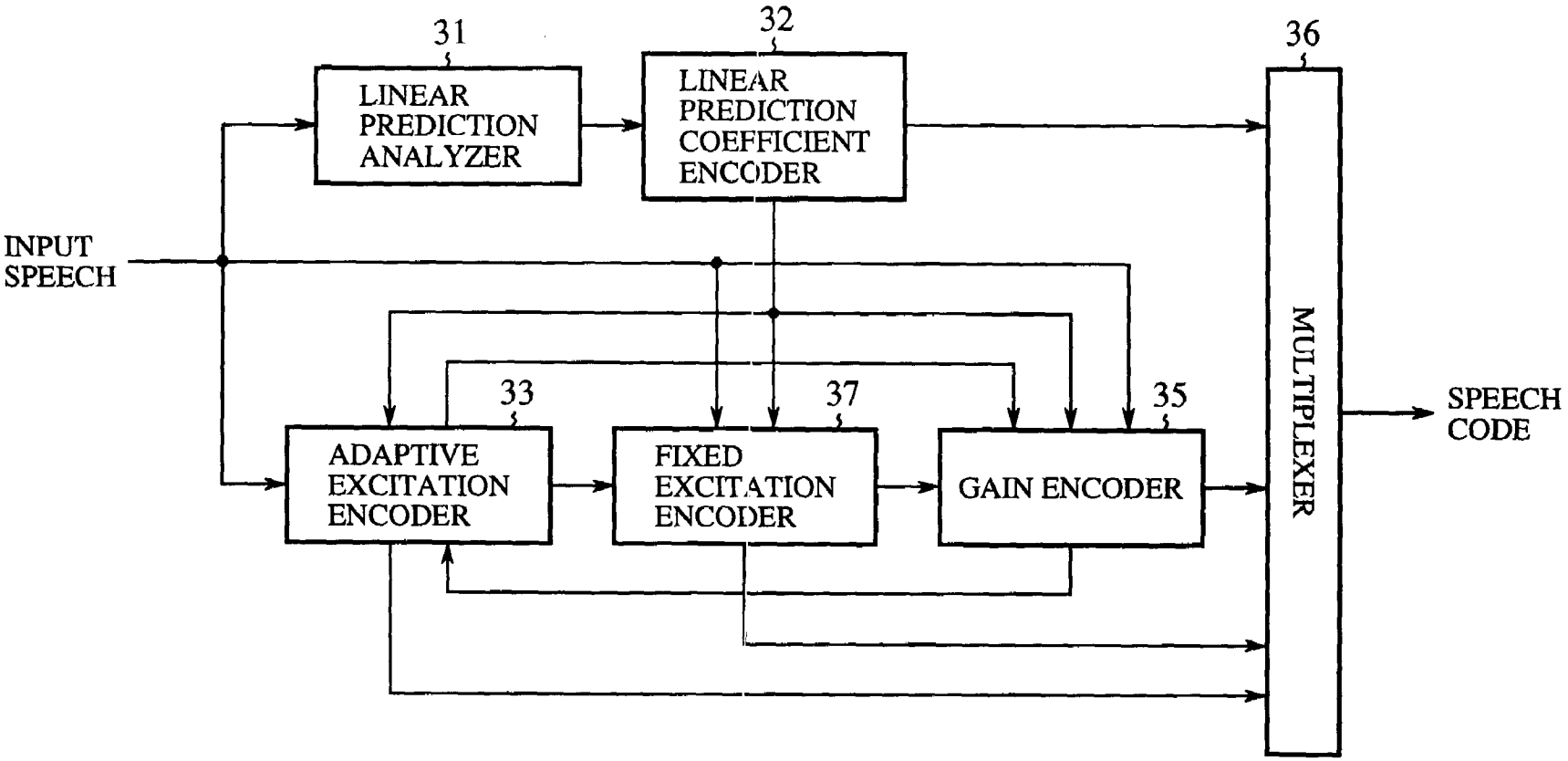
FIG. 8 is a block diagram showing a configuration of an embodiment 3 of the speech encoding apparatus in accordance with the present invention.

FIG. 8 is a block diagram showing a configuration of an embodiment 3 of the speech encoding apparatus in accordance with the present invention. In FIG. 8, the same reference numerals as those of FIG. 4 designate the same or like portions, and the description thereof is omitted here.

In FIG. 8, the reference numeral 37 designates a fixed excitation encoder (sound source information encoder) that generates temporary synthesized speech using the quantized values of the linear prediction coefficients the linear prediction coefficient encoder 32 outputs, selects the fixed excitation code that will minimize the distance between the temporary synthesized speech and the target signal to be encoded (the signal obtained by subtracting from the input speech the synthesized speech based on the adaptive excitation signal) and supplies it to the multiplexer 36, and that supplies the gain encoder 35 with the fixed excitation signal consisting of the time series vectors corresponding to the fixed excitation code.

Figure 9:
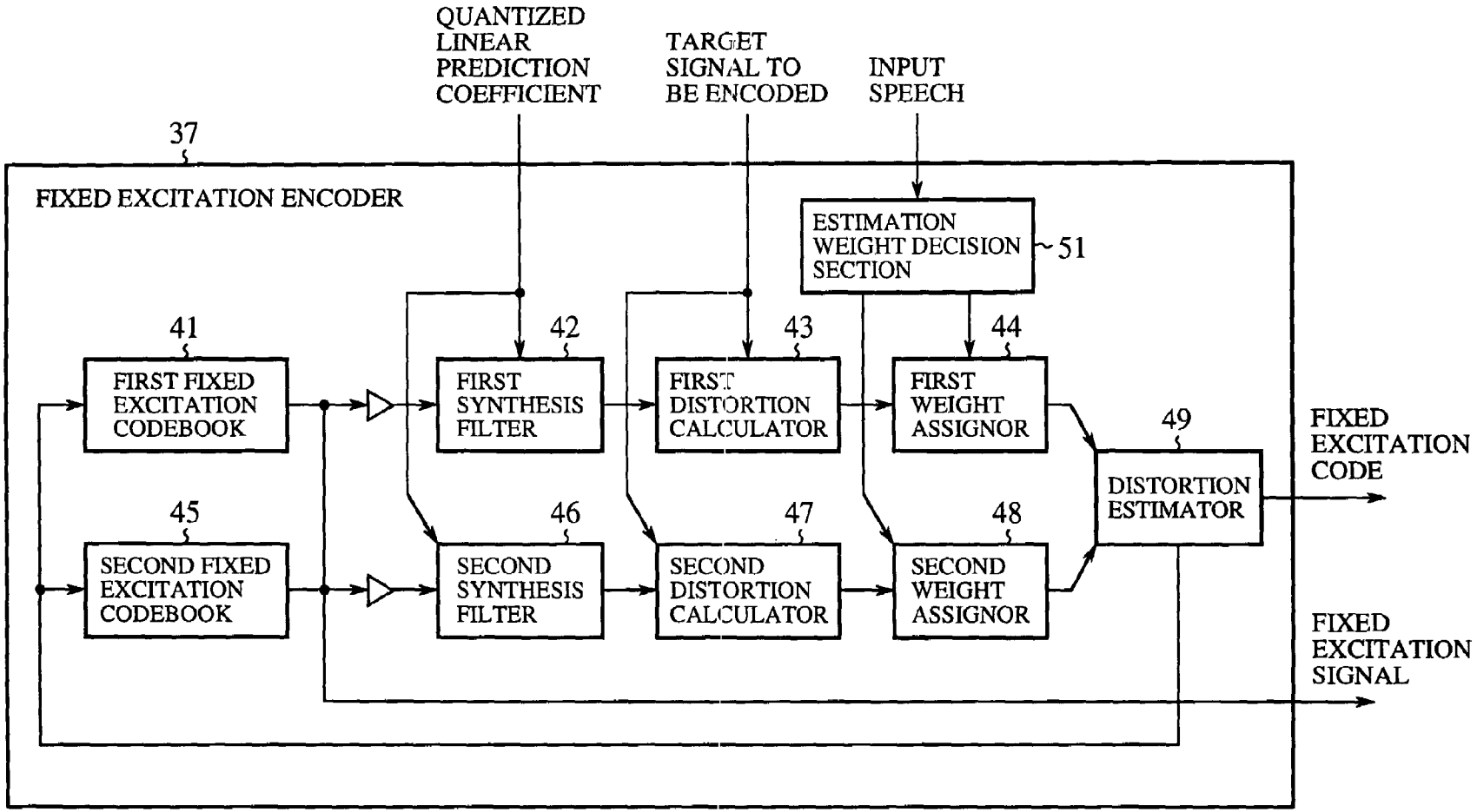
FIG. 9 is a block diagram showing an internal configuration of a fixed excitation encoder 37.

FIG. 9 is a block diagram showing an internal configuration of the fixed excitation encoder 37. In FIG. 9, the same reference numerals as those of FIG. 5 designate the same or like portions, and the description thereof is omitted here.

In FIG. 9, the reference numeral 51 designates an estimation weight decision section for varying weights in response to the noise-like degree of the input speech.

Next, the operation will be described.

Since the present embodiment 3 is the same as the foregoing embodiment 1 except that it includes the additional estimation weight decision section 51, only the different operation will be described.

The estimation weight decision section 51 analyzes the input speech, and determines the weights to be multiplied by the distances between the temporary synthesized speeches and the target signals to be encoded, which distances are output from the first distortion calculator 43 and second distortion calculator 47. Then, it supplies the weights to the first weight assignor 44 and second weight assignor 48.

The weights to be multiplied by the distances between temporary synthesized speeches and the target signals to be encoded are determined in accordance with the noise-like degree of the input speech. In this case, when the noise-like degree of the input speech is large, the weight assigned to the first fixed excitation codebook 41 with the greater noise-like degree is decreased, and the weight to be assigned to the second fixed excitation codebook 45 with the smaller noise-like degree is increased.

In other words, when the noise-like degree of the input speech is large, the present embodiment 3 facilitates the selection of the (noise-like) time series vectors with the large noise-like degree.

Thus, it can alleviate the degradation that the sound becomes pulse-like quality, which occurs in the conventional apparatus because of the frequent selection of the non-noise-like (pulse-like) time series vectors in sections in which the input speech has noise-like quality. Consequently, the present embodiment 3 offers an advantage of being able to implement subjectively high-quality speech codes.

EMBODIMENT 4

Figure 10:
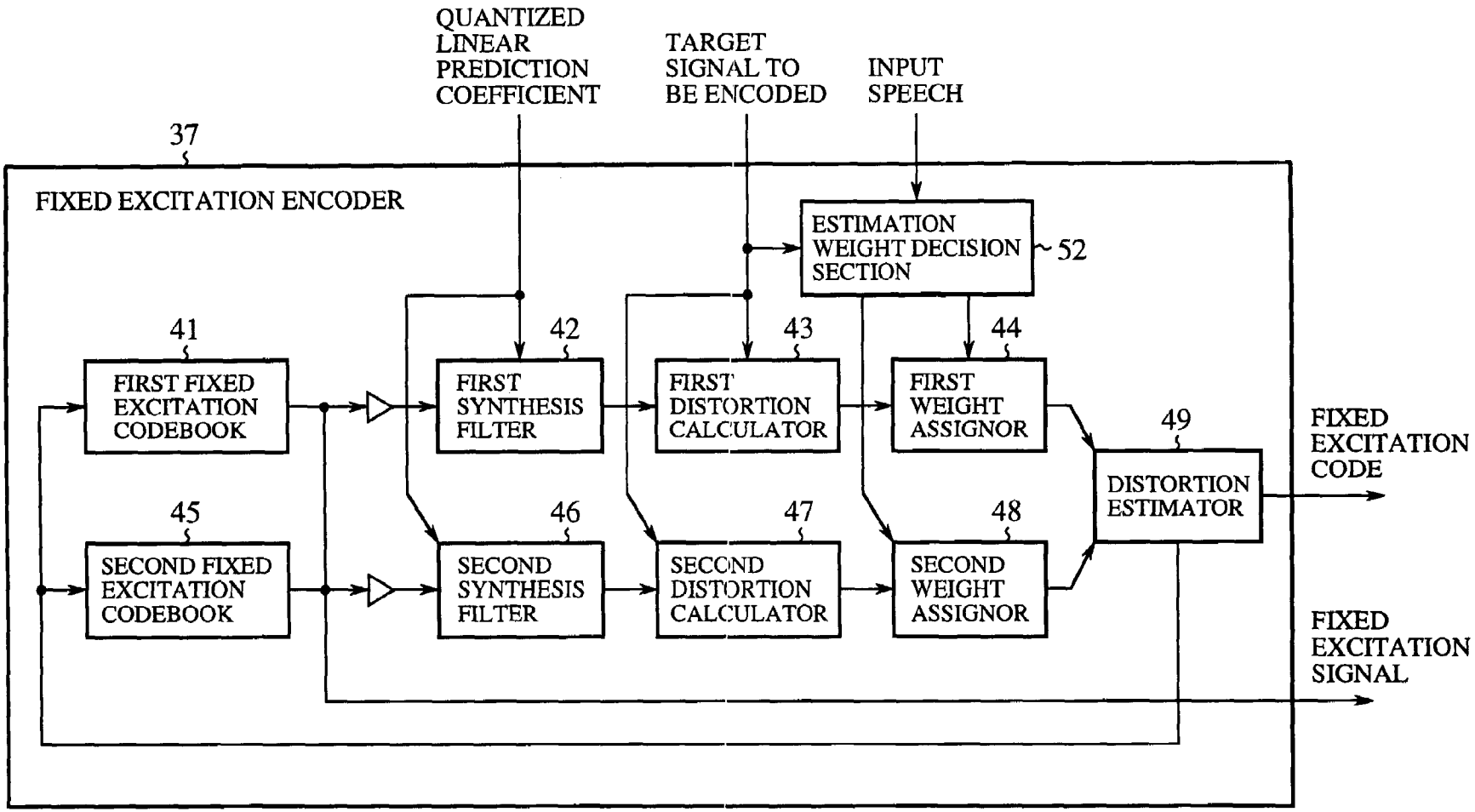
FIG. 10 is a block diagram showing an internal configuration of the fixed excitation encoder 37.

FIG. 10 is a block diagram showing another internal configuration of the fixed excitation encoder 37. In FIG. 10, the same reference numerals as those of FIG. 5 designate the same or like portions, and the description thereof is omitted here.

In FIG. 10, the reference numeral 52 designates an estimation weight decision section for varying weights in response to the noise-like degree of the target signal to be encoded and input speech.

Next, the operation will be described.

Since the present embodiment 4 is the same as the foregoing embodiment 1 except that it includes the additional estimation weight decision section 52, only the different operation will be described.

The estimation weight decision section 52 analyzes the target signal to be encoded and input speech, and determines the weights to be multiplied by the distances between the temporary synthesized speeches and the target signals to be encoded, which distances are output from the first distortion calculator 43 and second distortion calculator 47. Then, it supplies the weights to the first weight assignor 44 and second weight assignor 48.

The weights to be multiplied by the distances between temporary synthesized speeches and the target signals to be encoded are determined in accordance with the noise-like degree of the target signal to be encoded and input speech. In this case, when the noise-like degrees of both the target signal to be encoded and input speech are large, the weight assigned to the first fixed excitation codebook 41 with the greater noise-like degree is decreased, and the weight to be assigned to the second fixed excitation codebook 45 with the smaller noise-like degree is increased.

When either the target signal to be encoded or the input signal has a large noise-like degree, the weight to be assigned to the first fixed excitation codebook 41 is reduced to some extent, and the weight to be assigned to the second fixed excitation codebook 45 is increased a little.

In other words, according to the noise-like degree of the target signal to be encoded and that of the input speech, the present embodiment 4 controls the readiness of selecting the (noise-like) time series vectors with the large noise-like degree.

Thus, it can alleviate the degradation that the sound becomes pulse-like quality, which occurs in the conventional apparatus because of the frequent selection of the non-noise-like (pulse-like) time series vectors in sections in which the target signal to be encoded or input speech has noise-like quality. Although controlling the weights using both the target signal to be encoded and input speech complicates the processing as compared with the control using only one of them, it offers an advantage of being able to implement higher-order control of the weights, thereby further improving the quality.

EMBODIMENT 5

Figure 11:
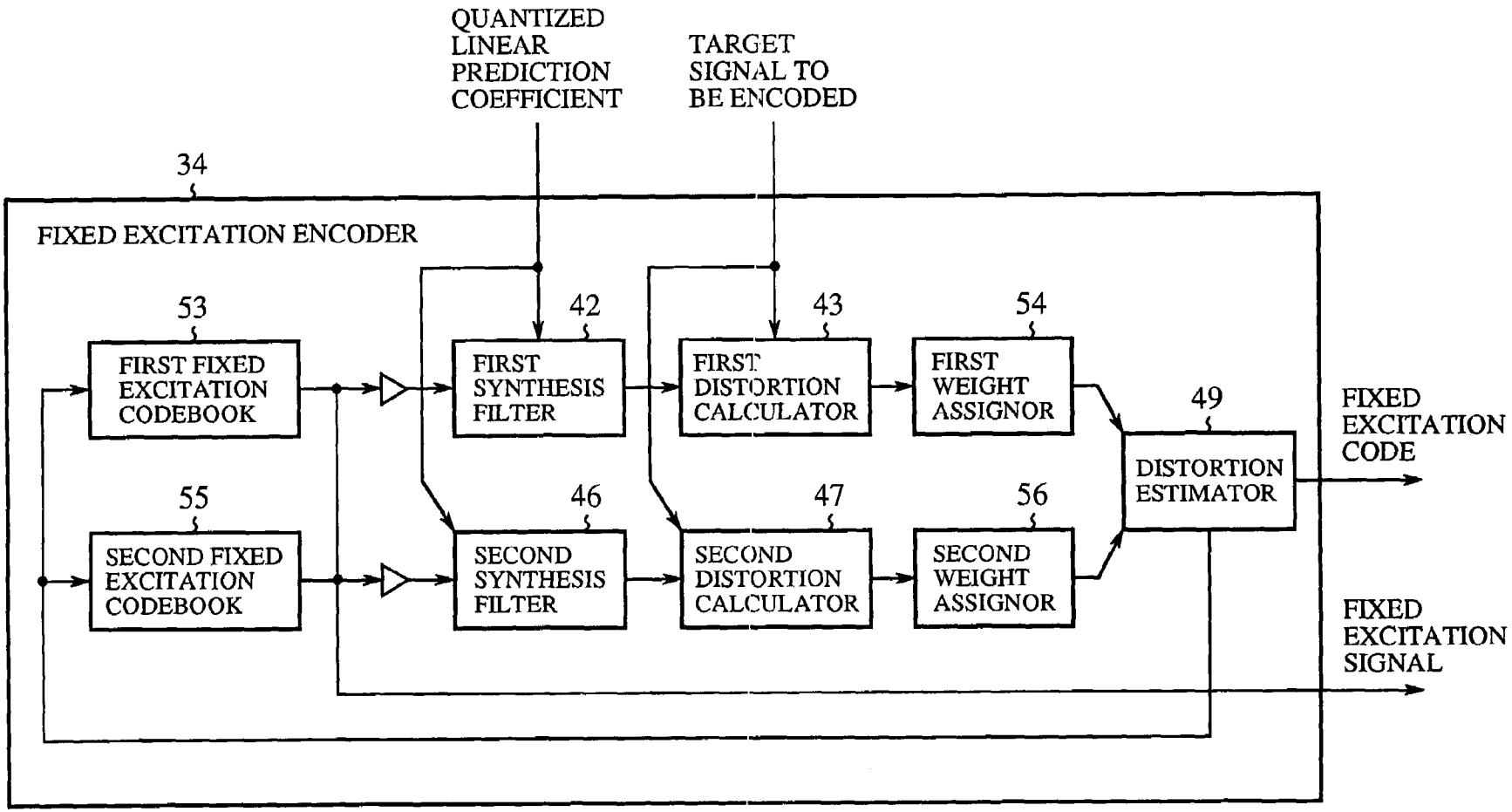
FIG. 11 is a block diagram showing an internal configuration of the fixed excitation encoder 34.

FIG. 11 is a block diagram showing an internal configuration of the fixed excitation encoder 34. In FIG. 11, the same reference numerals as those of FIG. 5 designate the same or like portions, and the description thereof is omitted here.

In FIG. 11, the reference numeral 53 designates a first fixed excitation codebook for storing multiple time series vectors (fixed code vectors). The first fixed excitation codebook 53 stores only a few time series vectors. The reference numeral 54 designates a first weight assignor for multiplying the calculation result of the first distortion calculator 43 by a weight which is set in accordance with the number of the time series vectors stored in the first fixed excitation codebook 53. The reference numeral 55 designates a second fixed excitation codebook for storing multiple time series vectors (fixed code vectors). The second fixed excitation codebook 55 stores a lot of time series vectors. The reference numeral 56 designates a second weight assignor for multiplying the calculation result of the second distortion calculator 47 by a weight which is set in accordance with the number of the time series vectors stored in the second fixed excitation codebook 55.

Next, the operation will be described.

Since the present embodiment 5 is the same as the foregoing embodiment 1 except for the fixed excitation encoder 34, only the different operation will be described.

The first weight assignor 54 multiplies the calculation result of the first distortion calculator 43 by the weight which is set in accordance with the number of the time series vectors stored in the first fixed excitation codebook 53.

The second weight assignor 56 multiplies the calculation result of the second distortion calculator 47 by the weight which is set in accordance with the number of the time series vectors stored in the second fixed excitation codebook 55.

More specifically, the weights the first weight assignor 54 and second weight assignor 56 use are preset in accordance with the numbers of the time series vectors stores in the fixed excitation codebooks 53 and 55, respectively.

For example, when the number of the time series vectors is small, the weight is reduced, whereas when it is large, the weight is increased.

Thus, the weight is set at a small value in the first weight assignor 54 corresponding to the first fixed excitation codebook 53 storing a small number of time series vectors. In contrast, the weight is set at a large value in the second weight assignor 56 corresponding to the second fixed excitation codebook 55 storing a large number of the time series vectors.

As a result, compared with the conventional apparatus without carrying out the weight assignment, the present embodiment 5 makes it easier to select the first fixed excitation codebook 53 having a smaller number of time series vectors, thereby enabling the ratio of selecting the individual fixed excitation codebooks independently of the scale or performance of the hardware. Thus, the present embodiment 5 offers an advantage of being able to implement the subjectively high-quality speech codes.

EMBODIMENT 6

Although the foregoing embodiments 1-5 include a pair of the fixed excitation codebooks, this is not essential. For example, the fixed excitation encoder 34 or 37 can be configured such that they use three or more fixed excitation codebooks.

Although the foregoing embodiments 1-5 explicitly include multiple fixed excitation codebooks, this is not essential. For example, time series vectors stored in a single fixed excitation codebook can be divided into multiple subsets in accordance with their types, so that the individual subsets can be considered to be individual fixed excitation codebooks, and assigned different weights.

In addition, although the foregoing embodiments 1-5 use the fixed excitation codebooks that store the time series vectors in advance, this is not essential. For example, it is possible to use a pulse generator for adaptively generating a pulse train with a pitch period in place of the fixed excitation codebooks.

Furthermore, although the foregoing embodiments 1-5 assign weights to the encoding distortion by multiplying the weights, this is not essential. For example, it is also possible to assign weight by adding weights to the encoding distortion. Besides, it is also possible to assign weight to the encoding distortion by making nonlinear calculation rather than linear calculation.

Moreover, the foregoing embodiments 1-5 make estimation by assigning weights to the encoding distortion of the time series vectors the multiple fixed excitation codebooks store, and select the fixed excitation codebook storing the time series vectors that will minimize the weighted encoding distortion. The scheme can extend the scope of its application to the sound source information encoder consisting of the adaptive excitation encoder 33, fixed excitation encoder 34 and gain encoder 35. Thus, a configuration is possible which includes a plurality of such sound source information encoders, makes estimation by assigning weights to the encoding distortions of the excitation signals the individual sound source information encoders generate, and selects the sound source information encoder generating the excitation signal that will minimize the weighted encoding distortion.

In addition, the internal configuration of the sound source information encoders can be modified. For example, at least one of the foregoing multiple sound source information encoders can consist of only the fixed excitation encoder 34 and gain encoder 35.

INDUSTRIAL APPLICABILITY

As described above, the speech encoding apparatus and speech encoding method in accordance with the present invention are suitable for compressing the digital speech signal to a smaller amount of information, and for obtaining the subjectively high-quality speech codes by making efficient use of the multiple fixed excitation codebooks.

What is claimed is:

1. A speech encoding apparatus that includes a sound source information encoder for selecting fixed excitation code for generating synthesized speech using the spectrum envelope information, and that outputs speech code of the input speech, said speech encoding apparatus comprising:

a first distortion calculator for calculating a first encoding distortion corresponding to a noise-like fixed code vector output by a first fixed excitation codebook for a frame of the input speech;

a first weight assignor for multiplying the first encoding distortion by a first fixed weight that is preset in accordance with a noise-like degree of noise-like fixed code vectors stored in said first fixed excitation codebook;

a second distortion calculator for calculating a second encoding distortion corresponding to a non-noise-like fixed code vector output by a second fixed excitation codebook for the frame of the input speech;

a second weight assignor for multiplying the second encoding distortion by a second fixed weight that is preset in accordance with a noise-like degree of non-noise-like fixed code vectors stored in said second fixed excitation codebook; and a distortion estimator for determining which of the noise-like and non-noise-like fixed code vector corresponds to the smaller one of the multiplication results obtained by said first weight assignor and by said second weight assignor, and selecting the determined one of the noise-like and non-noise-like fixed code vector to be the fixed excitation code, wherein the first fixed weight is different than the second fixed weight, and wherein the non-noise-like fixed code vectors stored in the second fixed excitation codebook are collectively more pulse-like, thus having a lesser noise-like degree, than the noise-like fixed code vectors stored in the first excitation codebook.

2. The speech encoding apparatus according to claim 1, wherein said sound source information encoder uses noise-like fixed code vectors and non-noise-like fixed code vectors with different noise-like degrees, respectively.

3. The speech encoding apparatus according to claim 1, wherein said sound source information encoder further comprises an estimation weight decision section for varying the weights in accordance with a noise-like degree of a target signal to be encoded.

4. The speech encoding apparatus according to claim 2, wherein said sound source information encoder further comprises an estimation weight decision section for varying the weights in accordance with a noise-like degree of a target signal to be encoded.

5. The speech encoding apparatus according to claim 1, wherein said sound source information encoder further comprises an estimation weight decision section for varying the weights in accordance with a noise-like degree of the input speech.

6. The speech encoding apparatus according to claim 2, wherein said sound source information encoder further comprises an estimation weight decision section for varying the weights in accordance with a noise-like degree of the input speech.

7. The speech encoding apparatus according to claim 1, wherein said sound source information encoder further comprises an estimation weight decision section for varying the weights in accordance with a noise-like degree of a target signal to be encoded and that of the input speech.

8. The speech encoding apparatus according to claim 2, wherein said sound source information encoder further comprises an estimation weight decision section for varying the weights in accordance with a noise-like degree of a target signal to be encoded and that of the input speech.

9. A speech encoding apparatus that includes a sound source information encoder for selecting fixed excitation code for generating synthesized speech, and that outputs speech code of the input speech, said speech encoding apparatus comprising:

a first distortion calculator for calculating a first encoding distortion corresponding to a fixed code vector output by a first fixed excitation codebook for a frame of the input speech;

a first weight assignor for multiplying the first encoding distortion by a first fixed weight that is preset in accordance with a number of the fixed code vectors stored in said first fixed excitation codebook;

a second distortion calculator for calculating a second encoding distortion corresponding to a fixed code vector output by a second fixed excitation codebook for the frame of the input speech;

a second weight assignor for multiplying the second encoding distortion by a second fixed weight that is preset in accordance with a number of the fixed code vectors stored in said second fixed excitation codebook; and a distortion estimator for determining which fixed code vector corresponds to the smaller one of the multiplication results obtained by said first weight assignor and by said second weight assignor, and selecting the determined fixed code vector to be the fixed excitation code, wherein the first fixed weight is different than the second fixed weight.

10. A speech encoding method of selecting fixed excitation code for generating synthesized speech, and outputting speech code of the input speech, said speech encoding method comprising the steps of:

calculating a first encoding distortion corresponding to a noise-like fixed code vector output by a first fixed excitation codebook for a frame of the input speech, and multiplying the first encoding distortion by a first fixed weight that is preset in accordance with a noise-like degree of noise-like fixed code vectors stored in said first fixed excitation codebook;

calculating a second encoding distortion corresponding to a non-noise-like fixed code vector output by a second fixed excitation codebook for the frame of the input speech, and multiplying the second encoding distortion by a second fixed weight that is preset in accordance with a noise-like degree of non-noise-like fixed code vectors stored in said second fixed excitation codebook;

determining which of the noise-like and non-noise-like fixed code vector corresponds to the smaller one of the multiplication results; and selecting the determined one of the noise-like and non-noise-like fixed code vectors to be the fixed excitation code, wherein the first fixed weight is different than the second fixed weight, and wherein the non-noise-like fixed code vectors stored in the second fixed excitation codebook are collectively more pulse-like, thus having a lesser noise-like degree, than the noise-like fixed code vectors stored in the first excitation codebook.

11. The speech encoding method according to claim 10, using noise-like fixed code vectors and non-noise-like fixed code vectors with different noise-like degrees, respectively.

12. The speech encoding method according to claim 10, varying the weights in accordance with a noise-like degree of a target signal to be encoded.

13. The speech encoding method according to claim 11, varying the weights in accordance with a noise-like degree of a target signal to be encoded.

14. The speech encoding method according to claim 10, varying the weights in accordance with a noise-like degree of the input speech.

15. The speech encoding method according to claim 11, varying the weights in accordance with a noise-like degree of the input speech.

16. The speech encoding method according to claim 10, varying the weights in accordance with a noise-like degree of a target signal to be encoded and that of the input speech.

17. The speech encoding method according to claim 11, varying the weights in accordance with a noise-like degree of a target signal to be encoded and that of the input speech.

18. A speech encoding method of selecting fixed excitation code for generating synthesized speech, and outputting speech code of the input speech, said speech encoding method comprising, when selecting the fixed excitation code, the steps of:

calculating a first encoding distortion corresponding to a fixed code vector output by a first fixed excitation codebook for a frame of the input speech, and multiplying the first encoding distortion by a first fixed weight that is preset in accordance with a number of the fixed code vectors stored in said first fixed excitation codebook;

calculating a second encoding distortion corresponding to a fixed code vector output by a second fixed excitation codebook for the frame of the input speech, and multiplying the second encoding distortion by a second fixed weight that is preset in accordance with a number of the fixed code vectors stored in said second fixed excitation codebook;

determining which fixed code vector corresponds to a smaller one of the multiplication results; and selecting the determined fixed code vector to be the fixed excitation code, wherein the first fixed weight is different than the second fixed weight.

* * * * *